US007216970B2

(12) United States Patent
Costanza et al.

(10) Patent No.: US 7,216,970 B2
(45) Date of Patent: May 15, 2007

(54) MOUNTING ASSEMBLY FOR A PRINT HEAD OF AN INK JET PRINTER

(75) Inventors: Daniel W. Costanza, Webster, NY (US); Michael F. Leo, Penfield, NY (US); Alexander J. Fioravanti, Penfield, NY (US)

(73) Assignee: Xerox Corporation, Stamford, CT (US)

( * ) Notice: Subject to any disclaimer, the term of this patent is extended or adjusted under 35 U.S.C. 154(b) by 250 days.

(21) Appl. No.: 11/127,987

(22) Filed: May 12, 2005

(65) Prior Publication Data

US 2006/0268045 A1 Nov. 30, 2006

(51) Int. Cl.
*B41J 25/304* (2006.01)

(52) U.S. Cl. ..... 347/108

(58) Field of Classification Search ..... 347/108, 347/222, 197, 263; 400/120.16
See application file for complete search history.

(56) References Cited

U.S. PATENT DOCUMENTS 5,455,604 A * 10/1995 Adams et al. ..... 346/138
5,710,586 A * 1/1998 Esplin et al. ..... 347/103
5,946,111 A 8/1999 Bock et al.
6,048,060 A * 4/2000 Narushima et al. ..... 347/104
6,070,977 A * 6/2000 Nuita et al. ..... 347/104
6,375,319 B1 * 4/2002 Kamano et al. ..... 347/104

* cited by examiner

*Primary Examiner*—Huan Tran
(74) *Attorney, Agent, or Firm*—Fay Sharpe LLP

(57) ABSTRACT

An ink jet printer includes a printer housing, an imaging drum, a drum frame connected to the printer housing and the imaging drum, a print head frame movably mounted in the printer housing, at least two print heads mounted to the print head frame, a first alignment pin connected to the print head frame, and a second alignment pin connected to the print head frame. The imaging drum includes first and second ends. The drum frame includes a first support connected to the first end of the imaging drum and a second support connected to the second end of the imaging drum. The first support includes a first docking station and the second support includes a second docking station. The print head is movable between a printing position and a cleaning position. Each alignment pin connects to the print head frame and extends generally towards the drum frame. The first alignment pin is adapted to be received by the first docking station when the print head frame is moved into the printing position. The second alignment pin is adapted to be received by the second docking station when the print head frame is moved into the printing position.

19 Claims, 5 Drawing Sheets

MOUNTING ASSEMBLY FOR A PRINT HEAD OF AN INK JET PRINTER

BACKGROUND

Known solid inject printers mount a single print head relative to an imaging drum. The print head deposits ink onto a print array of the imaging drum and a print media, e.g. a sheet of paper, passes over the imaging drum picking up the ink. The print head covers the entire print array of the imaging drum and the print array covers nearly the entire length of the imaging drum. Accordingly, the print head is referred to as a single nearly full width print head.

Periodically, the print head needs to be cleaned. The print head is mounted to a carriage that is pivoted away from the imaging drum so that the print head can be cleaned. A wiper comes down to clean the print head.

During printing, this known arrangement is capable of controlling the position of the print head relative to the position of the imaging drum because during the image formation phase of the print cycle the remainder of the printer is not functioning. Since during the image formation phase, the remainder of the printer is not functioning, the print heads do not experience any forces such as vibratory forces. When additional print heads are added to the printer and the printer is performing additional functions during the print cycle, the position of the print head relative to the imaging drum becomes more difficult to maintain.

SUMMARY

A mounting assembly in an ink jet printer includes a drum frame being adapted to support an associated imaging drum, a print head frame movably mounted with respect to the drum frame, at least two print heads mounted to the print head frame, a first alignment pin connected to the print head frame, and a second alignment pin connected to the print head frame. The drum frame includes first and second supports. The first support includes a first docking station and the second support includes a second docking station. The print head is movable between a printing position and a cleaning position. Both alignment pins extend from the print head frame towards the drum frame. The first alignment pin is adapted to cooperate with the first docking station when the print head frame is moved into the printing position. The second alignment pin is adapted to cooperate with the second docking station when the print head frame is moved into the printing position.

An ink jet printer includes a printer housing, an imaging drum, a drum frame connected to the printer housing and the imaging drum, a print head frame movably mounted in the printer housing, at least two print heads mounted to the print head frame, a first alignment pin connected to the print head frame, and a second alignment pin connected to the print head frame. The imaging drum includes first and second ends. The drum frame includes a first support connected to the first end of the imaging drum and a second support connected to the second end of the imaging drum. The first support includes a first docking station and the second support includes a second docking station. The print head is movable between a printing position and a cleaning position. Each alignment pin connects to the print head frame and extends generally towards the drum frame. The first alignment pin is adapted to be received by the first docking station when the print head frame is moved into the printing position. The second alignment pin is adapted to be received by the second docking station when the print head frame is moved into the printing position.

DETAILED DESCRIPTION

Figure 1:
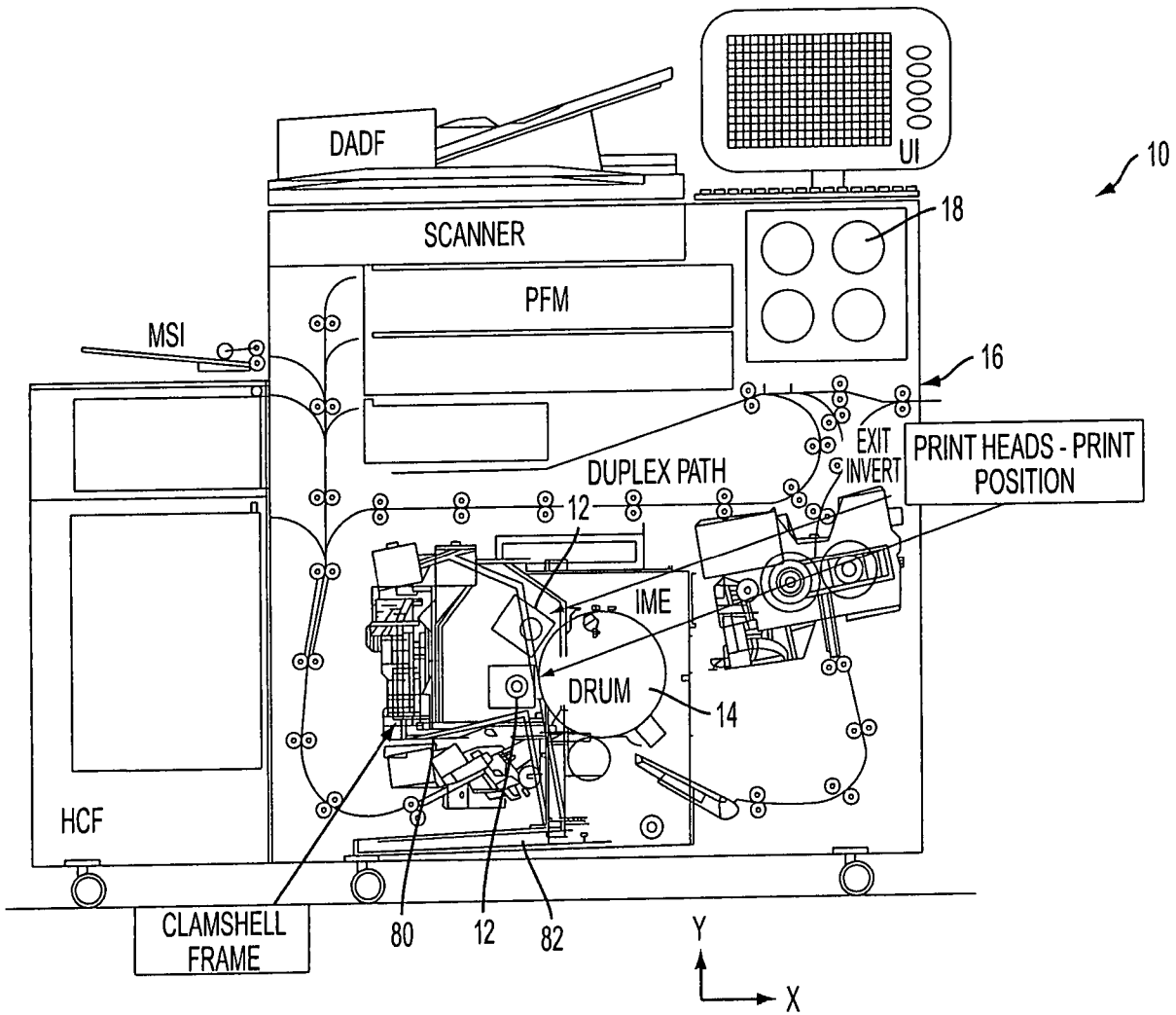
FIG. 1 is side cross-sectional view of an ink jet printer.

With reference to FIG. 1, a solid ink jet printer 10 includes a plurality of print heads 12 that transfer ink onto an imaging drum 14. The print heads 12 and the imaging drum 14 are disposed in a printer housing 16. Print media, which can include paper, travels around the drum 14 and picks up the ink deposited on the drum. The print heads 12 receive the ink from an ink reservoir 18 that is in fluid communication with the print heads.

Figure 2:
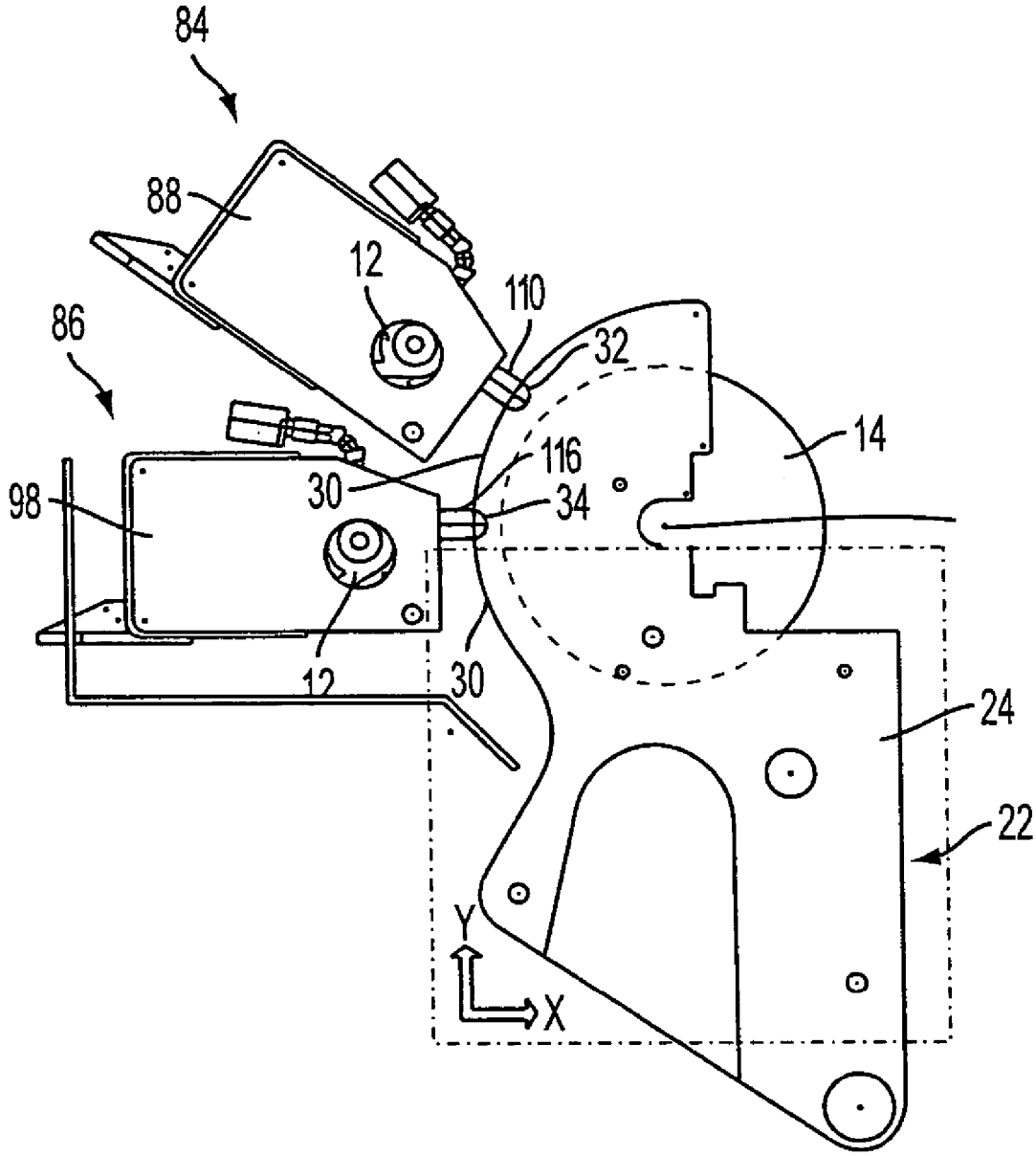
FIG. 2 is a side view of print head carriages cooperating with an imaging drum frame of the ink jet printer of FIG. 1.

With reference to FIG. 2, the imaging drum 14, which in the depicted embodiment is cylindrical, connects to a drum frame 22 that is connected to the printer housing 16. The imaging drum 14 rotates about an axis that will be referred to as the z-axis. To more easily describe the location and the movement of components in the ink jet printer 10, an x-axis runs horizontally as shown in FIG. 2 and a y-axis runs vertically as shown in FIG. 2.

Figure 3:
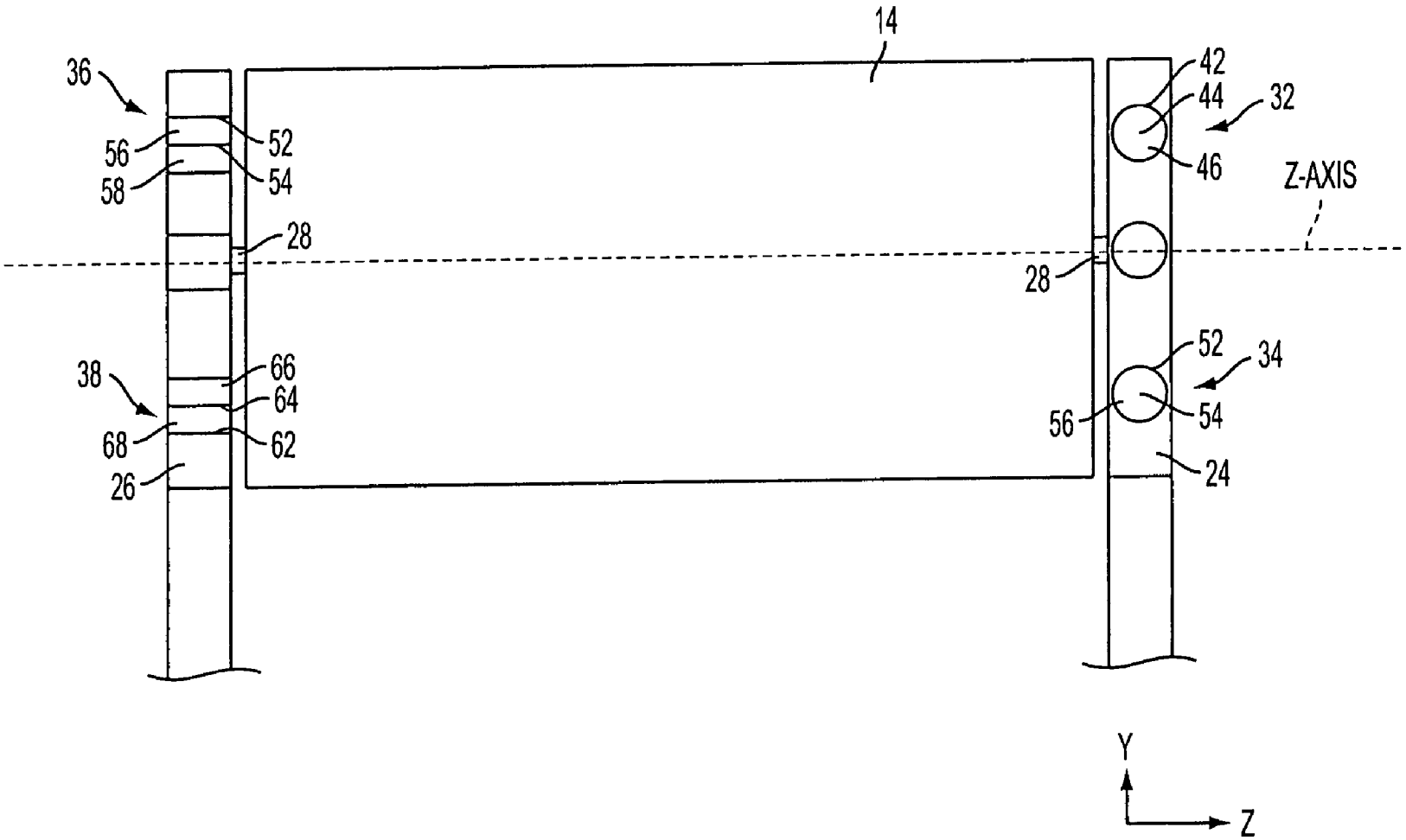
FIG. 3 is a front view of an imaging drum connected to the imaging drum frame of the ink jet printer of FIG. 1.

With reference to FIG. 3, the drum frame 22 includes a first support 24 that is connected to a second support 26. The drum frame 22 in the depicted embodiment is made from metal; however, other hard and durable materials can also be used to make the drum frame. A drum shaft 28, or shafts, connects a first end of the imaging drum 14 to the first support 24 and a second end of the imaging drum to the second support 26. The imaging drum 14 rotates about the shaft(s) 28 which are aligned with the z-axis. The supports 24 and 26 each include a curved surface that generally faces the print heads 12 (only a curved surface 30 is visible in FIG. 2).

Each support for the drum frame includes a docking station that facilitates aligning the print heads 12 relative to the imaging drum 14 when the print heads are in the printing position. With reference to FIG. 3, the first support 24 includes a first (upper) socket 32 and a second (lower) socket 34. The second support 26 includes a first (upper) v-shaped notch 36 and a second (lower) v-shaped notch 38. The upper socket 32 and the upper v-shaped notch 36 are aligned with one another along a line that is parallel to the z-axis, i.e. the axis of rotation of the drum 14. Likewise, the lower socket 34 and the lower v-shaped notch 38 are also aligned with one another along a line that is parallel to the z-axis. With reference to FIG. 2, the upper socket 32 and the lower socket 34 are spaced equidistant from the z-axis. Likewise, the upper v-shaped notch 36 and the lower v-shaped notch 38 are spaced equidistant from the z-axis.

The shape of the sockets 32 and 34 will be described with reference to FIGS. 3, 4 and 5. The sockets 32 and 34 have the same or at least substantially similar configurations.

Figure 4:
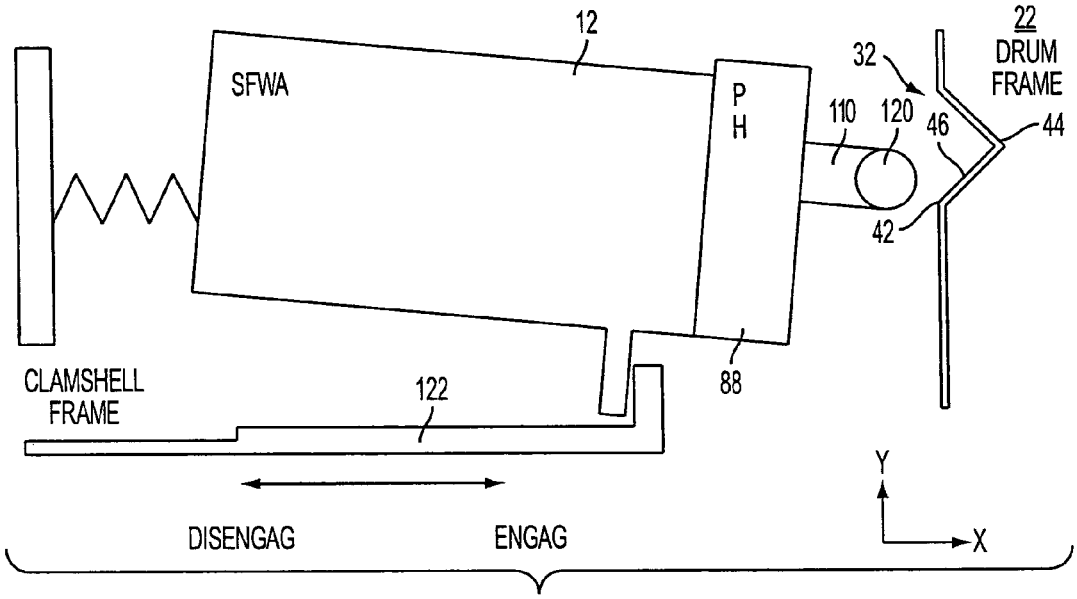
FIGS. 4 and 5 are schematic views of a printer head carriage cooperating with the drum frame of the ink jet printer of FIG. 1 where the drum frame is shown in a cross section taken normal to the axis of rotation of the imaging drum.
Figure 5:
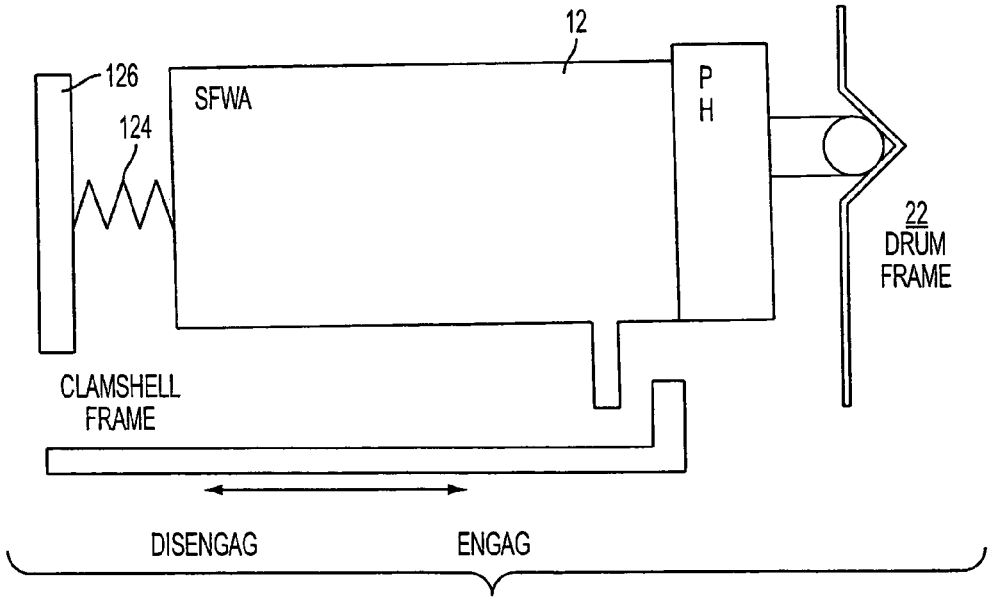

FIGS. 4 and 5 depict the upper socket 32, and it is understood that the lower socket 34 in the depicted embodiment has the same configuration. With reference to FIG. 3, the sockets 32 and 34 are conical in shape. The upper socket includes a circular mouth 42 that is wider than a base 44, which in the depicted embodiment is pointed. A socket wall 46 is tapered from the mouth 42 towards the base 44. In the depicted embodiment, the socket wall 46 is linear between the mouth 42 and the base 44 in a cross section taken normal to the z-axis. The lower socket 34 also includes a circular mouth 52, a pointed base 54 and a wall 56 between the mouth and the base. In the depicted embodiment, the upper and lower sockets are aligned with one another in a line that is parallel to the y-axis; however, in other configuration the sockets need not be aligned. The base of each socket is equidistant from the z-axis. The sockets 32 and 34 can take other configurations, for example, instead of the base being pointed, the base can have a more rounded configuration. Other configurations that can perform the same function that will be described below can also be used.

With reference back to FIG. 3, the upper v-shaped notch 38 includes a mouth 52 that is wider than a base 54. An upper tapered wall 56 extends between the mouth 52 and the base 54, and a lower tapered wall 58 extends between the mouth 52 and the base 54. In the depicted embodiment, when viewing the mouth 52 of the upper notch 36 from the print heads 12, the mouth appears rectangular. The lower v-shaped notch 38 has a similar configuration to the upper v-shaped notch 36. The lower v-shaped notch 38 includes a mouth 62, a base 64, an upper tapered wall 66 and a lower tapered wall 68. The base 44 of the upper socket 32 aligns with the base 54 of the upper v-shaped notch 36 in a line that runs parallel to the z-axis. Likewise, the base 54 of the lower socket 34 aligns with the base 64 of the lower v-shaped notch 38.

With reference back to FIG. 1, the print heads 12 connect to a print head frame 80 that is movable in relation to the imaging drum 14. The print head frame 80 mounts on a pair of tracks 82 (only one visible in FIG. 1) so that it can move linearly parallel to the x-axis away from the imaging drum 14. Alternatively, the print head frame 80 can pivot about an axis away from the imaging drum. In either case, an actuator, such as a motor, a piston, or the like, can be used to move the print head frame 80. After the print heads 12 have moved away a sufficient distance from the imaging drum 14, i.e. to a cleaning position, a wiper (not shown) comes down to clean the print heads 12. After the print heads 12 have been cleaned, the print head frame 80 moves back towards the imaging drum 14, either by pivoting or by linear movement, back into the printing position. In the printing position, the print heads 12 align with the imaging drum 14 so that a desired image can be provided on the print media that travels through the ink jet printer 10.

Figure 6:
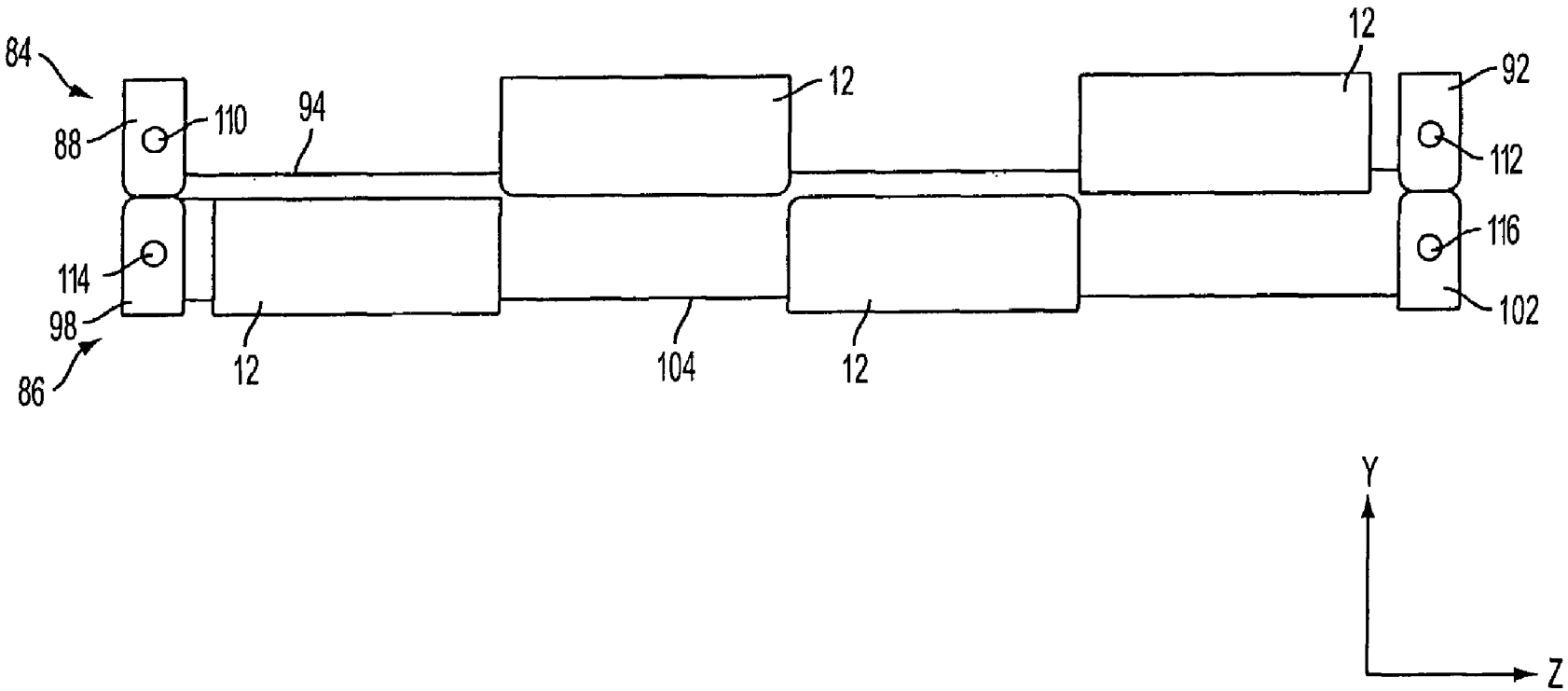
FIG. 6 is a front view of printer heads mounted to the printer head carriages of the ink jet printer of FIG. 1.

With reference to FIG. 6, a plurality of print heads 12 deliver ink to the imaging drum 14 (FIG. 2). The print heads 12 can be referred to as semi-full width array print heads since each print head only delivers ink to a portion of the imaging drum 14. The print heads in the depicted embodiment are spaced from one another along a line that is parallel to the z-axis, which is parallel to the rotational axis of the imaging drum 14. Also, the print heads 12 can be staggered in that they can also be spaced from one another in a direction that is parallel to the y-axis and in a direction that is parallel to the x-axis (see FIG. 2). In the depicted embodiment, four print heads 12 deliver ink to the imaging drum 14; however, a fewer or greater number of print heads can be provided.

The print heads 12 mount to print head carriages that attach to the print head frame 80. With reference back to FIG. 2, a first (upper) print head carriage 84 connects to the print head frame 80 and carries the upper print heads 12 that are shown in FIG. 6. A second (lower) print head carriage 86 also connects to the print head frame 80 and carries the lower print heads 12 depicted in FIG. 6. If desired, only one print head carriage can be provided and the print heads can connect to this one print head carriage The upper print head carriage 84 includes a first lateral support 88 spaced from a second lateral support 92 (FIG. 6). The lateral supports 88 and 92 are connected by a longitudinal support 94. Likewise the lower print head carriage 86 includes a first lateral support 98 spaced from a second lateral support 102. The lateral supports 98 and 102 are connected by a longitudinal support 104. The print head carriages 84 and 86 each have the same configuration in that the lateral supports 88, 92, 98 and 102 each reside in a plane that is parallel to the x-y plane.

Alignment pins cooperate with the docking stations to align the print heads 12 relative to the imaging drum 14. With reference back to FIG. 6, a first upper alignment pin 110 extends from the first lateral support 88 of the upper carriage 84 towards the imaging drum 14. A second upper alignment pin 112 extends from the second lateral support 92 of the upper carriage 84 also towards the imaging drum 14. A first lower alignment pin 114 extends from the first lateral support 98 of the lower carriage 86 and a second lower alignment pin 116 extends from the second lateral support 102 of the lower carriage 86. The lower pins 114 and 116 both also extend towards the imaging drum 14. The first upper alignment pin 110 cooperates with the first upper socket 32, the second upper alignment pin 112 cooperates with the upper V-shaped notch 36, the first lower alignment pin 114 cooperates with the lower socket 34 and the second lower alignment pin 116 cooperates with the lower v-shaped notch 38 when the print head frame 80 is moved into the printing position, such as that shown in FIGS. 1 and 2.

Cooperation between the first upper alignment pin 110 and the upper socket 32 will be described in detail, and it is understood that the other alignment pins will cooperate with the other docking stations in a similar manner, except where it is indicated to the otherwise. As the print head frame 80 (FIG. 1) moves towards the drum frame 22, the alignment pin 110 moves towards the socket 32. The alignment pin 110 includes a convex-shaped distal end 120 that is configured to be received inside the socket 32. The convex distal end 120 of the pin 110 has a diameter that is less than the diameter of the mouth 42 of the socket 32. When the print head 12 is spaced from the imaging drum 14 such that the print head is not in the printing position, the print head can fall onto a stop 122 that is positioned below the print head 12. The stop 122 is connected to at least one of the print head frame 80 and the print head carriage 84. The stop 122 limits the movement of the print head 12 in a generally vertical direction when the print head has disengaged the drum frame 22. The stop 122 can be positioned relative to the print head 12 so that the alignment pin 110 contacts the socket 32 inside of the mouth 42 when the print head is brought from the cleaning position back the printing position.

As the print head frame 80, and thus the print head 12, moves towards the imaging drum 14, the alignment pin 110 first hits the wider mouth portion 42 of the socket 34. As the print head frame 80 continues toward the drum frame 22, the alignment pin 110 moves along the ramped sidewall 46 of the socket 34 upward and toward the base 44. The convex shape of the distal end 120 of the pin 110 encourages this movement. With reference to FIG. 5, as the alignment pin 110 moves along the ramped sidewall 46 of the socket 34, the print head 12 is lifted off of the stop 122. A biasing member 122 that extends from a wall 124, which can be connected to the carriage 88 and/or the print head frame 80, biases the print head 12 towards the drum frame 24.

The sockets 32 and 34 are shaped to limit movement of the first upper alignment pin 110 in five different directions: (1) movement is limited in two opposite directions that are both parallel to the rotational axis of the imaging drum 14 (e.g. the z-axis) by the distal end 120 contacting the conical side wall 46, (2) movement is also limited in two opposite directions (e.g. vertically up and down as depicted in FIGS. 4 and 5) that lie in a plane that is normal to the rotational axis of the imaging drum 14 (e.g. the x-y plane) by the distal end 120 contacting the conical side wall 46, and (3) movement is limited in one direction (e.g. horizontally to the right as depicted in FIGS. 4 and 5) that lies in the plane that is normal to the rotational axis of the imaging drum 14 (e.g. the x-y plane).

The upper v-shaped notch 36 is shaped to limit movement of the second upper alignment pin 112 in three different directions: (1) movement is limited in two opposite directions (e.g. vertically up and down as depicted in FIGS. 4 and 5) that lie in a plane that is normal to the rotational axis of the imaging drum 14 (e.g. the x-y plane) by the upper tapered wall 56 and the lower tapered wall 58 contacting the alignment pin 112 and (2) movement is limited in one direction (e.g. horizontally to the right as depicted in FIGS. 4 and 5) that lies in the plane that is normal to the rotational axis of the imaging drum 14 (e.g. the x-y plane). The alignment pin that is received in the v-shaped notch is free to move in the z-axis. This allows for manufacturing tolerances. The angle between the line running through the length of the print head, which is parallel to the z-axis, and the velocity vector of the drum 14 is controlled by the position of the docking stations located on the drum frame.

The gap between the print heads 12 and the drum 14 are controlled by the length of the alignment pins and the depth of the respective docking stations. The alignment pins can be threaded so that the length that the alignment pins extend from the respective print head carriage can be adjusted. The biasing force provided by the biasing member 124 on the print heads 12 retains the print heads in the respective docking stations during vibrations imparted on by the printer while it is performing other functions.

The mounting assembly and arrangement that has been described above has been found to limit the motion of the print heads with respect to the imaging drum in both a direction along the rotational axis of the drum and in an axis that is perpendicular to the rotational axis to provide a high-quality image on the print media.

It will be appreciated that various of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims.

The invention claimed is:

1. A mounting assembly in an ink jet printer, the assembly comprising:

a drum frame being adapted to support an associated imaging drum that mounts to the drum frame, the drum frame including a first support and a second support spaced from the first support, the first support including a first docking station and the second support including a second docking station;

a print head frame movably mounted with respect to the drum frame, wherein the print head frame is movable between a printing position and a cleaning position;

at least two print heads mounted to the print head frame;

a first alignment pin connected to the print head frame and extending generally towards the drum frame, the first alignment pin being adapted to cooperate with the first docking station when the print head frame is moved into the printing position; and a second alignment pin connected to the print head frame and extending generally towards the drum frame, the second alignment pin being adapted to cooperate with the second docking station when the print head frame is moved into the printing position.

2. The assembly of claim 1, wherein the first docking station comprises a substantially cone-shaped recess.

3. The assembly of claim 1, wherein the second docking station comprises a v-shaped notch.

4. The assembly of claim 1, wherein each docking station is adapted to restrict movement of the respective alignment pin in a first axis and a first direction that is perpendicular to the first axis.

5. The assembly of claim 4, wherein the first docking station is adapted to restrict movement of the first alignment pin in a second axis that is perpendicular to both the first axis and the first direction.

6. The assembly of claim 1, wherein the first alignment pin includes a distal end having a convex surface.

7. The assembly of claim 1, wherein the first alignment pin is adjustable in a distance that the pin extends from the print head frame.

8. The assembly of claim 1, further comprising a stop member connected to the print head frame, the stop member being positioned in relation to the print head frame to limit the movement of at least one of the print heads when the print head frame is moved from the printing position towards the cleaning position.

9. The assembly of claim 1, further comprising a biasing member connected to the print head that biases the print head towards the drum frame.

10. The assembly of claim 1, wherein at least one print head is spaced from another print head in an axis that is parallel to a rotational axis of the associated imaging drum.

11. The assembly of claim 10, wherein at least one print head is spaced from another print head in a direction that is generally perpendicular to the rotational axis of the associated imaging drum.

12. An ink jet printer comprising:

a printer housing;

an imaging drum having first and second ends;

a drum frame connected to the printer housing, the drum frame having a first support connected to the first end of the drum and a second support connected to the second end of the drum, the first support including a first docking station and the second support including a second docking station;

a print head frame movably mounted in the printer housing with respect to the drum frame, wherein the print head frame is movable between a printing position and a cleaning position;

at least two print heads mounted to the print head frame;

a first alignment pin connected to the print head frame and extending generally towards the drum frame, the first alignment pin being adapted to be received by the first docking station when the print head frame is moved into the printing position; and a second alignment pin connected to the print head frame and extending generally towards the drum frame, the second alignment pin being adapted to be received by the second docking station when the print head frame is moved into the printing position.

13. The printer of claim 12, wherein the printer head linearly reciprocates between the printing position and the cleaning position.

14. The printer of claim 12, wherein each of the docking stations is shaped to encourage a respective alignment pin to seat in the docking station to limit movement of the alignment pin in two directions, each direction being perpendicular to a rotational axis of the imaging drum.

15. The printer of claim 14, wherein the first docking station is shaped to limit movement of the first alignment pin in a third direction that is perpendicular to both of the two directions and parallel to the rotational axis of the imaging drum.

16. The printer of claim 12, wherein the first support includes two docking stations that are spaced from one another in a direction that is at least generally perpendicular to a rotational axis of the drum.

17. The printer of claim 12, wherein the first docking station is aligned with the second docking station along a line that is parallel to a rotational axis of the drum.

18. The printer of claim 12, wherein the imaging drum defines a print array upon which ink is deposited, and at least one of the printer heads supplies ink to only a portion of the print array measured along a rotational axis of the drum.

19. The printer of claim 12, further comprising a stop connected to the print head frame, wherein the stop limits movement at least one of the print heads in a direction that is perpendicular to a rotational axis of the drum when at least one print head is in a position other than the printing position.

* * * * *